US005971648A

United States Patent [19]

Koreska

[11] Patent Number: 5,971,648

[45] Date of Patent: Oct. 26, 1999

[54] PEN FOR APPLYING A COLOR OR CORRECTION LIQUID

[75] Inventor: Peter Koreska, Vienna, Austria

[73] Assignee: Kores Holding Zug AG, Zug, Switzerland

[21] Appl. No.: 09/051,757

[22] PCT Filed: Oct. 18, 1996

[86] PCT No.: PCT/AT96/00202

§ 371 Date: Apr. 20, 1998

§ 102(e) Date: Apr. 20, 1998

[87] PCT Pub. No.: WO97/15460

PCT Pub. Date: May 1, 1997

[30] Foreign Application Priority Data

Oct. 20, 1995 [CH] Switzerland ..... 2977/95
Nov. 12, 1995 [CH] Switzerland ..... 3236/95

[51] Int. Cl.[6] ..... B43K 1/06

[52] U.S. Cl. ..... 401/260; 401/259

[58] Field of Search ..... 401/260, 259, 401/258, 209, 214, 235

[56] References Cited

U.S. PATENT DOCUMENTS

| | | | |
|---|---|---|---|
| 1,378,016 | 5/1921 | Erwin . | |
| 2,984,393 | 5/1961 | Magnenat . | |
| 3,379,490 | 4/1968 | Schwartzman | 401/260 |
| 4,541,552 | 9/1985 | Scheithauer | 401/260 |

FOREIGN PATENT DOCUMENTS

| | | |
|---|---|---|
| 0 331 843 A1 | 9/1989 | European Pat. Off. . |
| 0 564 410 A1 | 10/1993 | European Pat. Off. . |
| 329.628 | 6/1903 | France . |
| 461.361 | 10/1913 | France . |
| 2 665 649 | 2/1992 | France . |
| 1 001 624 | 1/1957 | Germany . |
| 43 04 910 A1 | 8/1994 | Germany . |

*Primary Examiner*—David J. Walczak
*Attorney, Agent, or Firm*—Pillsbury Madison & Sutro, LLP

[57] ABSTRACT

A pen for applying a color liquid whose sleeve part (1) includes an outlet port (3) for the color liquid, closable by a valve. The valve comprises a spring means incorporating at least one leaf spring (6, 6') or a disk spring, and a guiding element (4) pressed by the spring means against a sphere (5) which thereby is biased towards the outflow port (3). When the pen tip is pressed against an underlying substrate, the sphere (5) assumes an open position. The leaf or disk springs (6; 6') can be made of plastics and can be produced in one piece with the guiding element (4).

21 Claims, 2 Drawing Sheets

PEN FOR APPLYING A COLOR OR CORRECTION LIQUID

BACKGROUND OF THE INVENTION

1. Field of the Invention

The invention relates to a pen for applying a colour or correction liquid comprising a sleeve part having an outlet port for the colour liquid, a valve comprising at least one spring means and a guiding element, and a sphere associated with the outlet port and serving as an applicator element. The terms "colour or correction liquid", or "colour liquid", are intended to mean not only pigmented liquids, but also correction liquids without colour pigments.

2. Prior Art

In adhesive dispensers or paste applicating devices it has been known (e.g. DE 10 01 624 B and U.S. Pat. No. 2,984,393, respectively) to bias a rod which serves as a valve member into a closed position, via a spring moulded thereto, in which it closes an outlet port of the dispenser or of the device, respectively. These dispensers or application devices, respectively, are, however, only suited for a relatively broad, unprecise application of the materials contained therein. In contrast, however, particularly with colour or correction liquids, an exact, easy and optionally thin-lined application is desirable.

Another adhesive dispenser has been proposed (EP 331 843 A), in which a sphere serves as applicator element and valve member. This sphere is directly actuated by a spring element, such as a spring disk or a spiral spring. The spring element may, however, retain the sphere not at all, or only poorly, against lateral movements when adhesive is being applied with the sphere being pressed back from the outlet port. Thus, only a comparatively imprecise application of material is possible, which may suffice in case of adhesive dispensers, but which is insufficient for applying a colour or correction liquid. This also applies to a dispensing mechanism arranged at a side of a bottle cap and comprising a directly spring-actuated sphere as disclosed in U.S. Pat. No. 1,378,016.

To attain good movability of a colour applying tip in colour applying writing or correction pens, especially when applying correction liquids, and for an exact application thereof, the tip is provided with a sphere that is rotatably mounted in the sleeve part. For colours that have a low viscosity or which dry up quickly it is also important that an outflow of colour and/or solvent is possible only during the colour applying procedure. According to EP 564 410 A1 (comparable solutions also being disclosed in FR 2 665 649 A, FR 461 361 A, FR 329 628 and DE 43 04 910 A), a solution to this problem consists in the sphere acting as applicator element being pressed from the the interior of the sleeve to the rim of the outlet port by a guiding or transmitting element, in particular a rod-shaped element, which is pressed against the sphere by a spiral or helical spring. To apply colour liquid at a desired site on a paper, a pen with a sphere—which may have a small diameter—is pressed against the site, and optionally is moved over the paper, so that the sphere is pressed slightly away from the outflow port against the spring force, and colour can emerge.

The spring, the rod, the sphere and the sleeve thus form a valve which is closed when the tip of the pen is not pressed so as to prevent an undesired flowing out and/or drying up of the colour liquid. The guiding element formed by the rod holds and guides the sphere in the region between the closing and the opening positions. For the required properties of resilience, spiral or helical springs of metal are used.

These springs must be mounted with a respective bearing on the guide rod element and on the pen. For mounting on the pen, a bearing part is inserted into the sleeve, e.g. after introduction of the sphere, guide element and spring. To attain the desired valve properties, the two bearings must, however, be exactly spaced apart, and the spring must have the correct resilience properties.

Known pens have the drawback that various small parts, among which is a spring made of metal, must be assembled exactly. Available spiral springs which are suitable for this application, are short and thus can be retained and inserted only poorly. The guiding element, the sleeve and the bearing part are preferably made of plastics. Inasmuch as separation of a metal spiral spring from the other structural elements of different material for disposal purposes is rather complex, such pens constitute undesired two-component refuse.

SUMMARY OF THE INVENTION

The present invention has as its object to provide pens suitable as colour applicators having a sphere as a colour applicator element and a guiding element arrangement in such a manner that their production and assembly process is simplified; disposal thereof is to be simplified; and a fine, exact application of the colour or correction liquid and safe closing of the valve are ensured.

A pen according to one embodiment of the invention is characterized in that the spring means comprises at least one leaf spring, optionally a disk spring or a section of a disk spring.

The spring means required for a valve comprises at least one leaf spring, i.e. an elongated spring element, extending substantially in the direction of the guiding element and capable of deflecting transversely to its longitudinal extension under the action of force thereby changing its shape. Thus, during deformation, the shape of individual windings of a spring is not substantially maintained as in case of a spiral or helical spring. Instead, just the distance between the spring ends is changed. For comparable resilience properties, the leaf spring provided according to the invention is longer, as compared to spiral or helical springs, yet it requires less space in cross-section. In case of an arrangement inside a sleeve this is advantageous since the elongated design facilitates holding the spring during insertion and assembly, and the small cross-section does not impair the passage of colour liquid.

In the valves of colour-applying pens, the resilience of slightly bent leaf springs is utilized substantially along their longitudinal direction. In this case, e.g., the one end of the leaf spring being connected with a colour carrying sleeve, and the other end is connected with the guiding element that being arranged in a spring or is held in contact therewith undisplaceably. When a shift of the guiding element in the sleeve is caused by pressing the sphere onto an underlying substrate, the elongated spring element is increasingly deformed or bent in its transverse direction and thus is shortened in its longitudinal direction. The force resulting from the elastic deformation in the direction of the guiding element closes the valve, and thus the outlet port, reliably when the tip of the pen is no longer pressed against the underlying substrate.

Since in most instances the guiding element is arranged centrally in the sleeve and does not make contact with the sleeve even with reversible displacement substantially along its longitudinal axis caused by spring means, at least two, and optionally three or four leaf springs, are arranged substantially symmetrically with respect to the longitudinal axis of the guiding element.

If a plurality of identical leaf springs around the guiding element lead away from the latter towards the sleeve, they create a bell-shaped structure which substantially corresponds to a disk spring. Thus it will be understood that disk springs or sections of disk springs in a wider sense will be considered as "leaf springs" and may be used within the scope of the invention.

The leaf or disk springs may be made of plastics so that if the applicator element sphere also is made of plastics a pen substantially comprised of one single material will be the result. After having been used, such a single-component pen can be recycled without requiring separating procedures.

However, the provision of spheres made of metal does not pose significant disposal problems because the latter—in contrast to tightly clamped spiral metal springs—fall out or can be taken out easily from support given them by the shape of the outlet port when pulling out the inner parts of such a pen.

If the spring means and the guiding element are made of plastics, it is possible to design the two parts as one piece. According to a preferred embodiment of the invention, the spring means comprises a joining part connectable with the sleeve part, and preferably insertable thereinto. In this instance, the spring means is connected with the joining part at one of its end regions and with the guiding element at the other end. The interconnected parts may be produced as a coherent injection-moulded part and inserted in the sleeve with minimum effort whereby its resilience properties will depend on its production only, and not on assembling.

To prevent the applicator element sphere from being moved too far inwardly into the interior of the sleeve part when applying colour or correction liquid, it is also advantageous if the guiding element includes an abutment surface, which comes to abut an opening abutment so as to limit its displacement, against the force of the spring in the direction away from the outlet port. For a simple production or assembly, it is furthermore desirable if the opening abutment is connected with the spring means, in particular with a joining part of the spring means which is capable of being attached to the sleeve part, the guiding element being adjacent a first end region of the spring means, and the opening abutment being adjacent a second end region of the spring means.

For desired resilience with a guiding function simultaneously being achieved it has furthermore proven advantageous if the spring means comprises at least one leaf spring provided with a curved, for example, a U or S-shaped section, which, when the guiding element is moved away from the outlet port, is capable of being deformed such that a restoring force is created.

With a view to enabling particularly fine-lined applications, or applications requiring comparatively highly inclined pens, it is also advantageous that between the sphere serving as applicator element and the guiding element, at least one further sphere be provided, whereby this further sphere, or at least one of these further spheres, is capable of resting against a closing abutment of the sleeve part by the guiding element under the action of the spring means. In this case, the applicator element sphere may be small and have a weak retention, since the closing forces are accommodated and transmitted by the further sphere(s). Moreover, it is possible that the sphere serving as applicator element be capable of being brought into closing contact with the outlet port substantially free from pressure by means of the further sphere contacting the closure abutment. Also in this instance it is advantagous if the diameter of the sphere serving as applicator element is smaller than the diameter of the further sphere(s).

Finally, it is advantagous if the further sphere is capable of being rotated by rotational movement of the sphere serving as an applicator element, and that by the rotational movement of the further sphere a drawing action or conveyance of the colour liquid into a space present between the two spheres can be attained.

BRIEF DESCRIPTIONS OF THE DRAWINGS

The invention will now be explained in more detail by way of preferred exemplary embodiments illustrated in the drawings.

DETAILED DESCRIPTION OF PREFERRED EMBODIMENTS OF THE INVENTION

Figure 1:
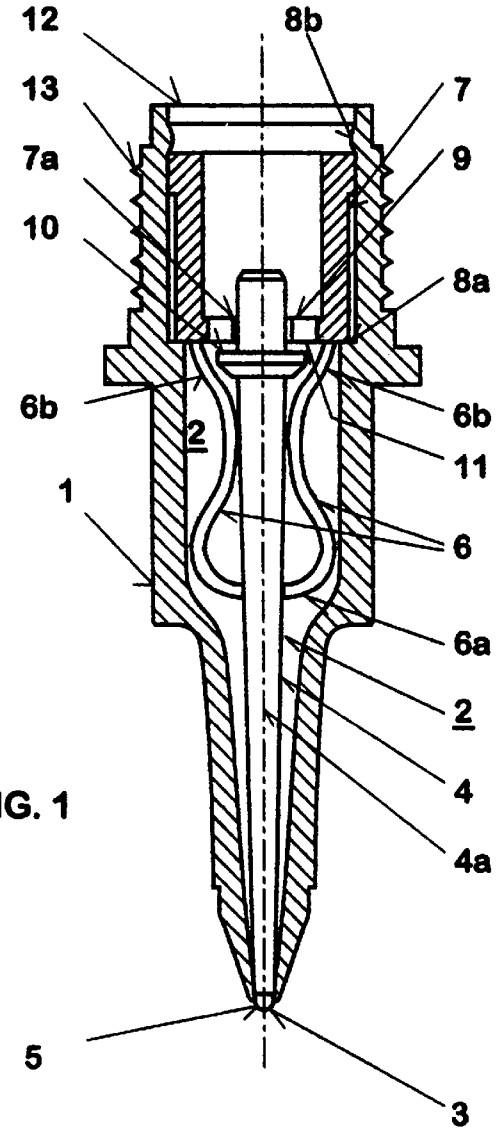
FIG. 1 is a sectional view through an applicator tip of a pen having a sphere and a guiding element which is connected with a joining part via two leaf springs.

FIG. 1 shows a sleeve part 1 of the pen tip of a pen for applying colour liquid. The sleeve part 1 encloses a colour space 2, and on one outlet end it includes an outlet port 3 for the colour liquid. To feed the colour space 2 with colour liquid, a joining port 12 is provided. The joining port 12 is surrounded by a joining region, in particular a screw thread 13, so that the sleeve part 1 is joinable to a colour container. An applicator sphere 5 is pressed against the outlet port 3 away from the colour space 2 by means of a rod-shaped guiding element 4. To this end, the guiding element 4 is pressed against the outlet port 3 by at least one leaf spring, two in the present example, optionally also several leaf springs 6, which are substantially symmetrically arranged relative to an axis 4*a* of the guiding element 4. A first end region 6*a* of the leaf springs 6 contacts the guiding element 4 within sleeve portion 1 without possibility for displacement, and preferably, region 6*a* is connected with element 4. A second end region 6*b* of the leaf springs 6 optionally contacts the sleeve part 1 or is connected therewith. In the present exemplary embodiment, an annular joining part 7 is provided to connect the end regions 6*b* of the leaf spring 6 with the sleeve part 1 and is held in the sleeve part 1 by a clamping fit. An inner insertion delimiting means 8*a* having the form of a shoulder and an outer bead 8*b* delimit the clamping fit in the sleeve part 1. The joining part 7 has a central guiding region 7*a* for the guiding element 4. According to FIG. 1, this guiding region 7*a* is formed by radially inwardly directed projections 9. Between the projections 9, a sufficiently large passage aperture region for the colour liquid is provided.

The leaf springs 6 illustrated preferably are made of plastics and are S-shaped, having two opposing regions of curvature. Upon movement of the guiding element 4 away from the outlet port 3, at least the radius of curvature of the one curvature region decreases. This elastic deformation causes a corresponding restoring force.

In addition to (or optionally instead of ) the guiding function, the projections 9 of the joining part 7 have the function of an abutment for delimiting the movement of the guiding element 4 in the direction away from the outlet port 3. For this purpose, the rod-shaped guiding element 4 has an abutment surface 10 projecting radially outwardly like a collar contacting the lower side of the projections 9 at the maximum displacement of the guiding element 4 thereby defining an opening abutment 11. Such an opening abutment 11 may, however, also be connected with the sleeve part 1 and/or with the joining part 7 separately from the projections 9. The length of the opening abutment 11 is selected such that the applicator element sphere 5 always projects beyond the outlet port 3 to a sufficient extent so as to ensure the application of colour.

Of course, the design, number and arrangement of the leaf springs 6 can be chosen according to the respective demand. Optionally, the guiding element 4 is sufficiently well guided by the leaf springs 6 to do without a guiding region 7*a*. The opening abutment 11 will particularly be required if it is not desired that the applicator element sphere 5 be pressed completely into the sleeve portion 1. If under certain conditions of use it is immaterial whether or not the rim of the outlet port 3 contacts the underlying substrate when the pen tip is strongly pressed against this underlying substrate, the opening abutment 11 is not necessary. Optionally, it may be effected, by means of a sufficiently high resilience of the leaf springs 6, that the applicator sphere 5 will always protrude slightly even at nomal writing pressure and thus will remain capable of being rolled.

Figure 2:
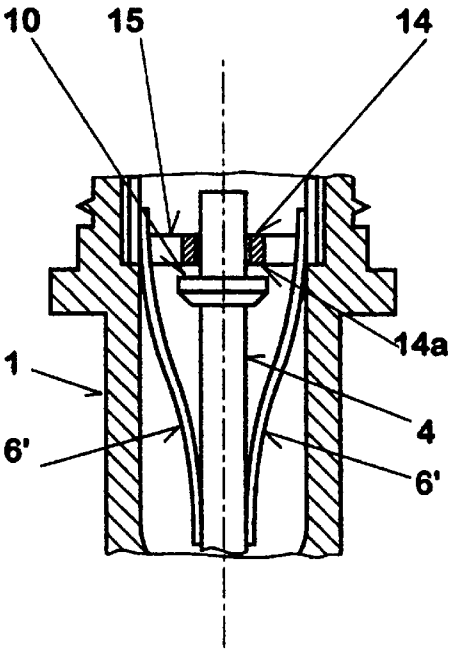
FIG. 2 is a detailed sectional view through a pen-applicator tip having slightly bent leaf springs.

FIG. 2 shows an embodiment in which leaf springs 6' having only slight ranges of curvature connect the guiding element 4 with the joining part 7. In the closed position (with the outlet port 3 closed), the shape of a suitable leaf spring should be such that the first end region 6*a* of the leaf spring 6 can be shifted away from the port 3, and the displacement of the end region 6*a* will lead to a deformation of the leaf spring 6 causing restoring forces. The leaf springs thus may have different designs. Optionally, leaf springs may be provided which extend more or less radially and thus substantially not along the guiding element 4. In such an embodiment, axial displaceability of the guiding element 4 is relatively slight, and thus a guiding range and an opening abutment optionally can be omitted.

The guiding and abutment ranges for the guiding element 4 may, according to FIG. 2, also be designed as a ring 14 extending around the guiding element 4. To connect the ring 14 with the joining part 7, spoke-type radial connecting means 15 are provided. To form an opening abutment, the abutment surface 10 of the guiding element 4 has an associated oppositely arranged lateral surface 14*a* of the ring 14. Since the radial connecting means 15 and the ring 14 are designed to be narrow, the free cross-section of the colour space 2 will only be a little bit smaller. The design of the leaf springs 6' will impede a passage of the colour liquid through the colour space 2 insubstantially.

Figure 3:
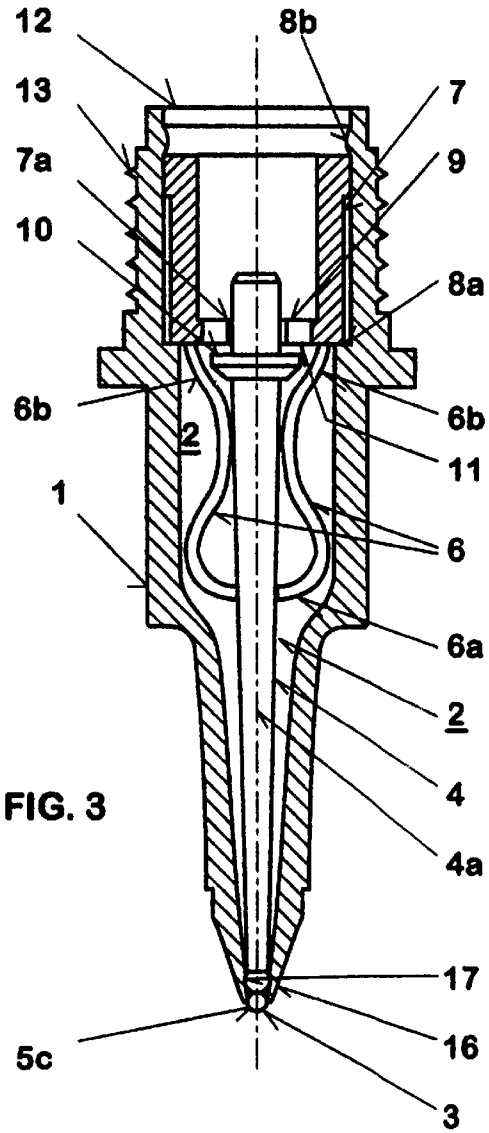
FIG. 3 is a sectional view through an applicator tip of a pen similar to FIG. 1, but comprising two spheres and a guiding element which is connected with a joining part via two leaf springs.
Figure 4:
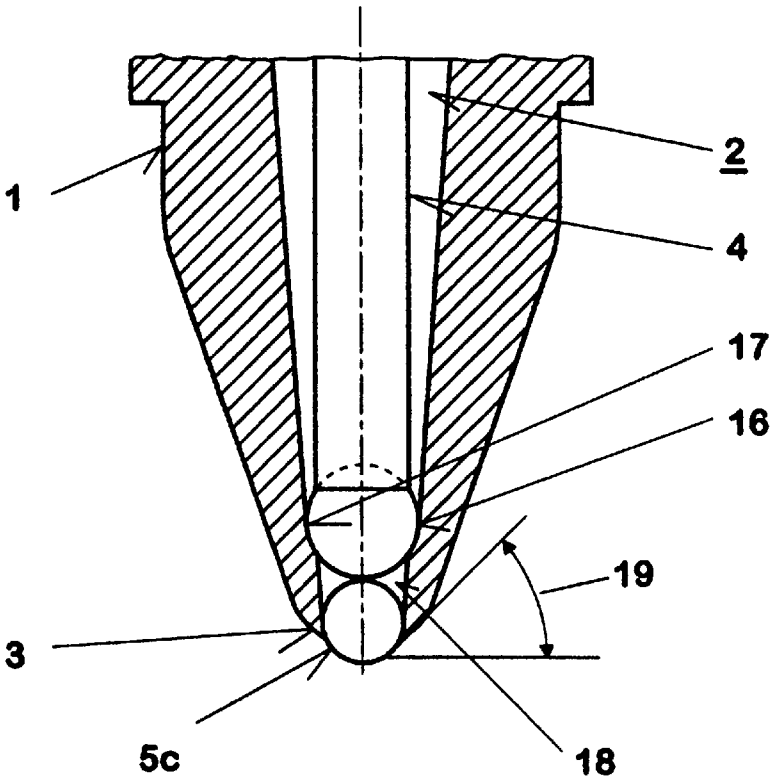
FIG. 4 is a sectional view through the end region of an applicator tip comprising two spheres on a scale enlarged as compared to FIG. 3.

FIG. 3 shows a pen tip of a pen for applying colour liquid which is designed to correspond substantially to the pen tip according to FIG. 1. The design according to FIG. 3, and in an enlarged representation according to FIG. 4, comprises a second sphere 16 provided between the applicator element sphere 5*c* and the end of the guiding element 4 facing the same. Within the sleeve part 1, a closure fit or a closure abutment 17 for the second sphere 16 is provided and adapted thereto, so that the second sphere 16 which is pressed by the guiding element 4 against the seating 17 sealingly closes off the colour space 2. By the second sphere 16 which contacts the closure abutment 17, the applicator sphere 5*c* is maintained substantially free from pressure in closing contact with the outlet port 3.

For the present pens, a valve generally is provided in the region of the pen tip which allows for the emergence of colour liquid only if the pen tip is pressed against an underlying substrate, or if the applicator sphere 5, 5*c* is slightly pressed towards the colour space 2. The valve comprises at least one spring means 6, 6' and a guiding element 4. Closure of the outlet is attained by a closing contact between at least one region of the inner rim of the sleeve part and the guiding element and/or at least one sphere.

In the embodiment according to FIG. 1, the applicator element sphere 5 serves as the closing element, and, in its closing position, it sealingly contacts the outlet port 3 from within. To prevent an escape of this applicator sphere 5, the rim of the outlet port 3 must be sufficiently hard and must embrace the applicator sphere by a sufficiently large extent. As a consequence, the applicator sphere 5 will project only slightly beyond the relatively wide rim of the outflow port 3, and the critical inclination of the pen, in which the valve can no longer be opened by pressing against the underlying substrate or at which a colour application is no longer possible, is relatively small.

In the embodiment according to FIG. 3, the second sphere 16 serves as the closing element which transmits the closing forces of the valve onto the closure seating 17. Thus, the possibility of a more compact valve design also is provided. Furthermore, the applicator sphere 5*c* need not be retained such that is must accommodate the closure forces. As a consequence, the rim of the outlet port 3 may be designed to be thin, so as to surround the applicator sphere 5*c* by only little more than one half. The pen thus may be inclined by a larger angle of aperture 19 (FIG. 4), up to 70°, which angle, however, for reasons of stability will lie between 25° and 45°, before the rim of the outlet port 3 will abut the underlying substrate and thus prevent the valve from being pressed open.

When moving the slightly pressed-on pen tip over an underlying substrate, the applicator sphere 5*c* will roll on the underlying substrate and will set into rotation the second sphere 16 with which it is in pressure contact. By the rotational movement of the second sphere 16, a good drawing action, i.e. a transport of colour liquid from the colour space 2 into a space 18 present between the two spheres 5*c*, 16 is attainable. By this arrangement, only such an amount of colour mass is applied as is actually required, on the one hand, while a clogging of the applicator sphere 5*c* is avoided, on the other hand.

Corresponding to the design of the sleeve cavity in the region of the outlet port, the diameter of the first sphere 5*c* optionally is somewhat smaller than the diameter of the second sphere 16.

Figure 5:
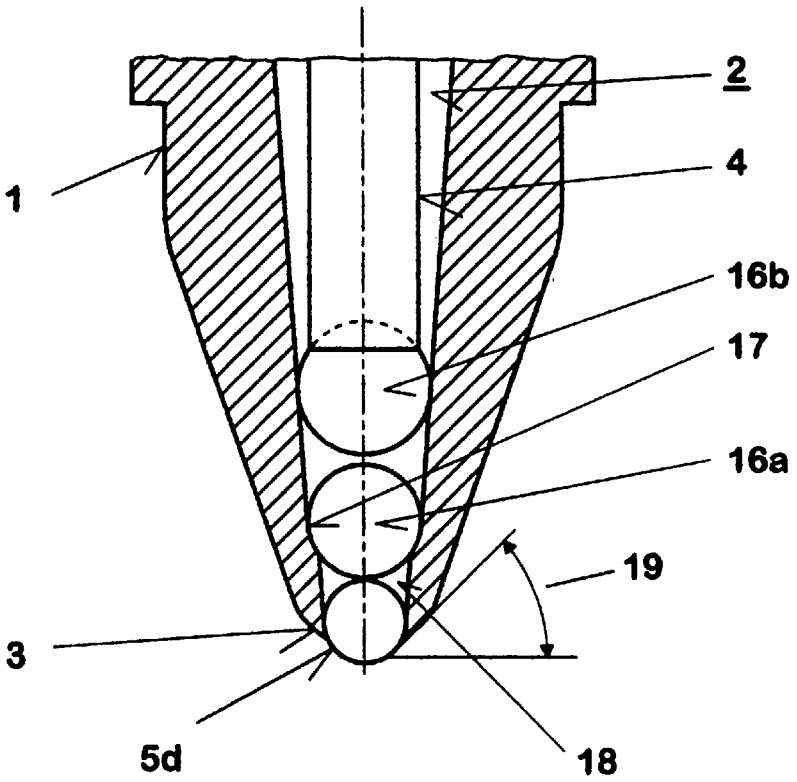
FIG. 5 is a sectional view through the end region of an applicator tip similar to FIG. 4, but comprising three spheres.

FIG. 5 shows a further possibility of colour transmission to the applicator sphere 5*d*. There, two further spheres 16*a*, 16*b* are provided, which take over transportation of the colour liquid, on the one hand, and act as closing element, on the other hand. The diameters of these two spheres 16*a*, 16*b* may optionally be different, in accordance with the inner dimensions of the sleeve cavity. If the sleeve cavity widens towards the colour space 2, the diameters of these spheres 16*a*, 16*b* will each be chosen to be larger.

To increase the amount of colour applied, several spheres could be arranged in one plane above the applicator sphere, optionally three spheres. Such an arrangement then would be generally tetrahedron-shaped, the tip of the tetrahedron being formed by the applicator sphere.

For ball-point pens or lacquer pens, e.g., embodiments having at least two spheres associated with the outlet port 3, optionally comprising different ones or none of the above-described embodiments of a spring means, may be of interest.

It will be understood that all the features of the above-described embodiments may be combined. Thus, e.g., further spheres 16 or 16*a*, 16*b* may also be provided in a pen having leaf springs 6' according to FIG. 2, and/or a ring 14 connected to spokes 15 may be provided in the pen according to FIG. 1 (or FIG. 3).

I claim:

1. A pen for applying a colour or correction liquid comprising a sleeve including an outlet port for the liquid, a valve incorporating at least one spring means and a guide element disposed within the sleeve, and a sphere associated with the outlet port and forming a liquid applicator element, wherein said spring means is disposed between the sleeve and the guide means and comprises at least one leaf spring section, and wherein the guide element includes an engagement surface adapted to engage an inner stationary abutment member within said sleeve so as to limit displacement of the guide element in a direction away from the outlet portion and against force of the spring means applied to the guide element.

2. A pen according to claim 1, wherein the spring means comprises a holding member connected with the sleeve.

3. A pen according to claim 2, wherein the holding member is adapted to be plugged into said sleeve.

4. A pen according to claim 1, wherein the spring means and the guide element are formed as a one-piece structure.

5. A pen according to claim 4, wherein the one-piece structure is made of plastic.

6. A pen according to claim 1 or 2, wherein said inner stationary abutment member is connected with said spring means, said guide element being located adjacent a first end region of said spring means, and said inner stationary member being located adjacent a second end region of said spring means.

7. A pen according to claim 6, wherein said inner stationary abutment member is connected with a holding member of said spring means attached to said sleeve.

8. A pen according to claim 1 or 2, wherein said spring means comprises at least one leaf spring with a curved section, which, when said guide element is moved away from said outlet port, is deformed such that a force is created in the spring means for urging the guide member towards the outlet port.

9. A pen according to claim 8, wherein said curved section of said leaf spring is U- or S-shaped.

10. A pen according to claim 1, wherein between said sphere which forms an applicator element and said guide element, at least one further sphere is disposed, said further sphere is adapted to be moved against a closure abutment of said sleeve by said guide element by said spring means.

11. A pen according to claim 10, wherein said sphere serving as applicator element is brought into closing contact with said outlet port, substantially free from pressure, by means of said further sphere contacting the closure abutment.

12. A pen according to claim 10 or 11, wherein said further sphere is rotatable by rotational movement of said sphere serving as an applicator element, whereby rotational movement of said further sphere draws the colour liquid into a space between the respective two spheres.

13. A pen according to claim 10 or 11, wherein the diameter of said sphere serving as applicator element is smaller than the diameter of said further sphere.

14. A pen according to claim 10 or 11, wherein the spring means comprises a holding member connected with the sleeve.

15. A pen according to claim 14, wherein the holding member is adapted to be plugged into said sleeve.

16. A pen according to claim 10 or 11, wherein the spring means and the guide element are formed as a one-piece structure.

17. A pen according to claim 16, wherein the one-piece structure is made of plastic.

18. A pen according to claim 10 or 11, wherein said inner stationary abutment member is connected with said spring means, said guide element being located adjacent a first end region of said spring means, and said inner stationary member being located adjacent a second end region of said spring means.

19. A pen according to claim 18, wherein said inner stationary abutment member is connected with a holding member of said spring means attached to said sleeve.

20. A pen according to claim 10 or 11, wherein said spring means comprises at least one leaf spring with a curved section, which, when said guide element is moved away from said outlet port, is deformed such that a force is created in the spring means for urging the guide member towards the outlet port.

21. A pen according to claim 20, wherein said curved section of said leaf spring is U- or S-shaped.

* * * * *